United States Patent [19]

Bayer

[11] Patent Number: 4,650,368

[45] Date of Patent: Mar. 17, 1987

[54] FLOOD WATER CONTAINMENT BAG

[75] Inventor: Robert T. Bayer, Asheville, N.C.

[73] Assignee: American Threshold Industries, Inc., Asheville, N.C.

[21] Appl. No.: 732,617

[22] Filed: May 10, 1985

[51] Int. Cl.[4] ..... E02B 7/00

[52] U.S. Cl. ..... 405/111; 405/107; 405/114; 405/116; 252/8.514

[58] Field of Search ..... 405/107, 109, 110, 111, 405/112, 114, 115, 116, 117; 252/8.5 A, 8.5 B

[56] References Cited

U.S. PATENT DOCUMENTS

| | | | |
|---|---|---|---|
| 3,172,267 | 3/1965 | Fisher | 405/107 |
| 3,186,896 | 6/1965 | Clem | 405/107 |
| 3,886,751 | 6/1975 | Labora | 405/18 |
| 4,362,433 | 12/1982 | Wagner et al. | 405/18 |
| 4,391,925 | 7/1983 | Mintz et al. | 166/273 |
| 4,401,475 | 8/1983 | Eriksson et al. | 134/7 |
| 4,405,257 | 9/1983 | Nielson | 405/19 |

FOREIGN PATENT DOCUMENTS

| | | | |
|---|---|---|---|
| 321703 | 1/1934 | Italy | 405/107 |

OTHER PUBLICATIONS

"Firestone Presents the Newest . . . Bag of Tricks", Firestone Catalog on Gabridam, 2-20-63.

*Primary Examiner*—Cornelius J. Husar
*Assistant Examiner*—Kristina I. Hall
*Attorney, Agent, or Firm*—Harvey B. Jacobson

[57] ABSTRACT

A flood water containment bag constructed of lightweight, inexpensive porous material with a quantity of water absorbent material therein which increases substantially in volume and weight when it absorbs water entering into the interior of the bag. The bag can be easily and quickly transported to a point of use and arranged in a plurality of superimposed courses when in a flattened lightweight condition and will expand to form a water barrier or wall. Fastener strips are attached to top and bottom surfaces of the horizontally arranged bags to enable them to be interconnected to stabilize the formed barrier.

11 Claims, 3 Drawing Figures

FLOOD WATER CONTAINMENT BAG

BACKGROUND OF THE INVENTION

1. Field of the Invention

The present invention generally relates to flood control or water containment arrangements in the form of lightweight, small volume bags constructed of material enabling inflow of water and preventing outflow or providing a restricted outflow to enable the bags to be easily transported to the site of use and placed in position for flood water control or water containment purposes so that when water penetrates the bags, water absorbent and expandable material interiorly of the bags will expand to the full volume of the bag to provide a water containment barrier or wall.

2. Information Disclosure Statement

When flood conditions occur, containment barriers, walls, levees and the like are constructed from bags filled with sand. Conventionally, bags and sand are separately conveyed to a point adjacent the site of use after which the bags are filled with sand and placed in position or alternatively, bags already filled with sand are transported to a point adjacent the site of use and the filled sandbags are placed in position to form a barrier, wall, levee or the like. These procedures require adequate trucking facilities and are quite labor intensive inasmuch as the handling of the sandbags, filling of the sandbags and the like require many hours of laborious work. Efforts have been made to provide other types of containment barriers, walls and the like and the following U.S. patents relate to this field of endeavor:

U.S. Pat. No. 3,886,751, P. J. Labora, June 3, 1975
U.S. Pat. No. 4,362,433, Wagner et al, Dec. 7, 1982
U.S. Pat. No. 391,925, Mintz et al, July 5, 1983
U.S. Pat. No. 4,401,475, Eriksson et al, Aug. 30, 1983
U.S. Pat. No. 4,405,257, E. Nielsen, Sep. 20, 1983

Even with the above-mentioned efforts to more effectively contain flood waters and the like, the conventional procedure still being used is the deployment of sandbags by manually placing the sandbags to form a barrier or wall with the sandbags either being filled on site or transported in filled condition on trucks with the sandbags ultimately being manually lifted and placed in position to form the desired barrier or wall.

SUMMARY OF THE INVENTION

An object of the present invention is to provide a flood water containment bag used with and in combination with a plurality of identical bags which are easily transported and placed in position to form a flood water containment barrier, wall, levee, dike or the like in which each bag is constructed to enable the interior of the bag to be permeated by moisture with the interior of the bag also including a water absorbent material which substantially expands in volume when wetted thereby enabling a bag having a relatively large volume to be transported when in a flattened, small volume condition with the flattened bags being positioned in a manner to form a flood water containment barrier or wall when the flood water permeates the bag and increases the volume of the material in the bag so that the bags will assume a maximum volume to form a containment wall.

A further object of the invention is to provide a flood water containment bag constructed of various materials which are porous to water with the water entering the bag when the water contacts the bag such as when flood waters rise to a particular level to come into contact with the bag which contains expandable material that expands in response to absorption of water which enters the bag thereby expanding the relatively small volume of the unexpanded bag into a maximum volume permitted by the bag so that the bags can be easily transported, handled and placed in position to form a containment barrier while in a small volume compact condition with the bags then being expanded as water enters the bags and expands the expandable material therein.

Another object of the invention is to provide a flood water containment bag with water absorbent expandable material therein in various embodiments and which greatly facilitates the transport of a plurality of bags to a site of use, handling of the bags from a truck or other transporting device to the point of placement to form a flood water barrier to reduce the energy and labor as well as the time required to transport and install a water containment barrier for flood waters and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
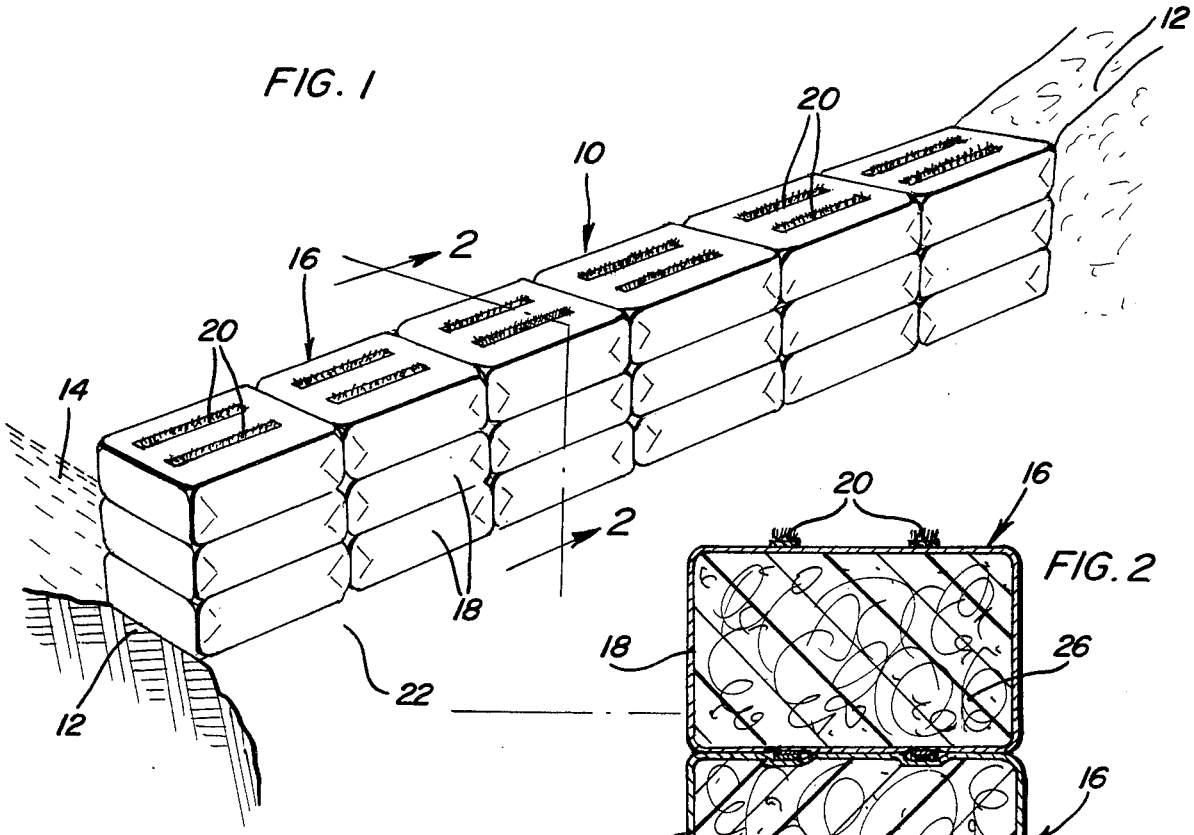
FIG. 1 is a perspective view of a water containment barrier or wall formed from a plurality of flood water containment bags of the present invention.
Figure 2:
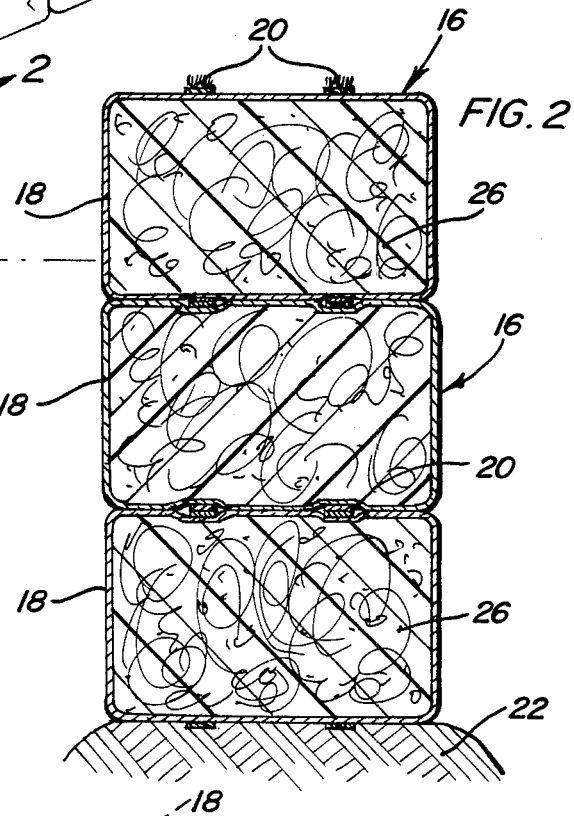
FIG. 2 is a vertical sectional view taken substantially upon a plane passing along section line 2—2 on FIG. 1 illustrating the manner in which the bags are interconnected to form a barrier or wall.
Figure 3:
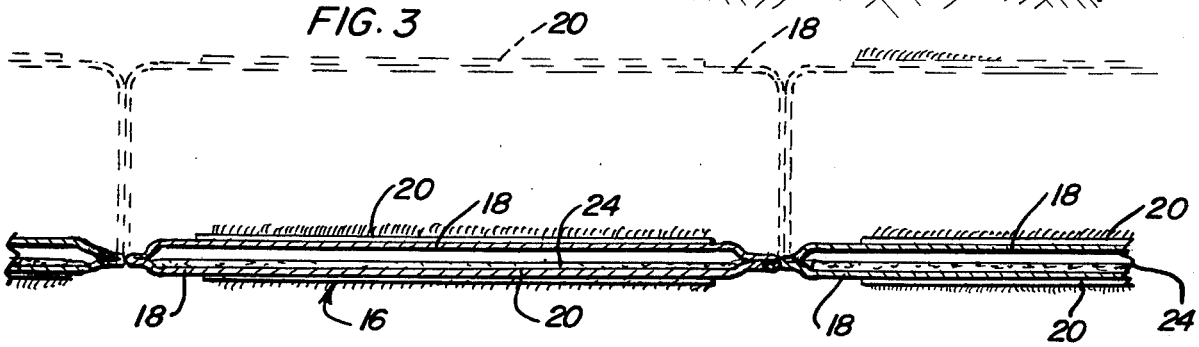
FIG. 3 is a fragmental sectional view illustrating the structure of the bags in their unexpanded condition with their expanded condition being illustrated in broken lines.

Referring now specifically to the drawings, a flood water containment barrier or wall is generally designated by the numeral 10 and is illustrated in position between the edges of a break or interruption in a wall, dam, dike, levee or other barrier 12 for retaining flood waters 14 from passing through the opening in the barrier 12. For example, if a levee has been broken by water overrunning the top of the levee or for any other reason, the containment barrier 10 may be quickly and easily installed in place to contain the flood waters. Also, the flood water containment barrier 10 may be erected in various positions in which sandbags and other similar flood containment devices are utilized. The barrier 10 includes a plurality of flood water containment bags each being generally designated by numeral 16 and including a peripheral wall 18 which may be constructed of various materials and may conveniently be of rectangular configuration with interconnecting devices 20 extending longitudinally of the longitudinal top and bottom surfaces, respectively, so that a plurality of the bags 16 may be stacked in superimposed relation on a supporting soil surface 22 or the like. The interior of each bag is provided with a quantity of water absorbent material 24 which is normally of small volume when dry but which will absorb water when wetted and expand into an expanded material 26 as illustrated in FIG. 2 with FIG. 3 illustrating the expandable material 24 when in a dry or dehydrated condition.

The bag 16 and, specifically, the peripheral wall 18 may be constructed from a non-woven, woven, knit, paper or plastic material all of which are porous. For example, commercially available polyethylenes and polypropylenes with small holes to allow passage of liquid can be used and are readily available. A combination of the above materials may be used with the combination being laminated together and which may be reinforced with "scrim" for strength. Thus, the material selected for constructing the bag is selected on the basis of the best "one-way valve" action, that is, the material will allow liquid to easily pass through from the exterior into the interior of the bag but once liquid passes through, it is more difficult for the liquid to flow back out. Examples of materials with these properties are a spunbonded polypropylene and the perforated plastic materials mentioned above.

The bags may be glued (hot melt or cold), sewn, heat sealed, dielectrically sealed or ultrasonically sealed and in any event will be such that the manner of forming the bag will easily lend itself to formation by automatic equipment thereby providing an economical, effective and low cost bag that enables it to be disposable.

The absorbent material 24 may be in the form of powder, fiber or laminate in which powder is laminated to paper or non-woven material. This material may be any of several commercially available "superabsorbents", starch based or synthetic such as starch-grafted copolymer or polyacrylic acid and polyacrylamide, modified cellulose fiber which is cross-linked carboxymethylcellulose (CMC), internally cross-linked starch-grafted polyacrylate polymer derived from starch and acrylic acid, aqueous polymer solution and hydrophilic polymer. The above-mentioned materials may be combined, to aid in wicking and/or absorbing, with pulp fluff, polyester propropylene fibers and other similar materials.

The absorbing material 24 may be loose within the bag or may be in laminate form or may be enclosed within an inner bag with such construction being a bag within a bag in which the outer bag is as described previously and the smaller inner bag holding the absorbent material may be of paper such as a water-soluble "dissolvable" paper. In order to add weight, other materials may be added to the absorbing material such as cement. The general features of the "superabsorbents" are to rapidly absorb a large volume of liquid (100–1000 times its own weight) and to expand and retain a large percentage of the liquid even under pressure. In some cases, the "superabsorbent" forms a gel which swells as it absorbs.

In one practical embodiment of the invention, a bag having a size of 26½ inches×14 inches (371 cu.in. flat) provided with 15½ grams of "superabsorbent" in powder form will expand or swell to approximately 750 cu.in. after absorbing water. The bags can be shipped and stored virtually flat similar to a pillow case which are sealed and folded on all four sides and easily transported and moved into position as required thereby eliminating the necessity of filling sandbags by hand, closing them by hand and then handling the heavy and cumbersome sandbags in order to place them in effective position. Even if sandbags are prefilled and transported to the site of use, it still is necessary to handle the heavy and unwieldy sandbags in order to place in position to effectively block or contain flood waters.

To aid in stacking and retaining them in vertically stacked relation in use, the fastener elements or interconnecting elements preferably are hook and loop pile fasteners such as "Velcro" with both a male and female strip being attached to both the top and bottom surfaces of each bag so that the bags can then be secured in stacked position. The absorbent material may include an anti-microbial chemical to retard the growth of mildew, rot and the like to prolong the effective life of the flood water containment bags. The bags, in their flat condition, may be supplied on continuous rolls with perforations in between each bag so that individual bags may then be unrolled and torn off when ready for use. Also, a time release chemical may be added to the absorbent material inside of the bag which will help seal the pores of the peripheral wall 18 of the bag thereby aiding in the one-way valve action to enable water to enter but restrict exit of water from the bags. Likewise, other types of one-way valve action structures may be provided such as simple one-way valves or the like to enable entry of water into the bag but prevent or retard exit of water from the bag.

With this construction of the bag, the bag can be manufactured in an efficient manner with existing machines in which the top and bottom, side and end walls are all of substantially straight construction with the ends being sealed transversely in any suitable manner that is conventional in the industry. The material from which the bag is constructed is porous and provides a one-way valve action to enable entry of water through the peripheral wall into the interior thereof so it will come in contact with and wet the absorbent material and expand the bag into a large volume having a parallelepiped configuration so that a plurality of unexpanded bags placed in vertically superimposed rows or courses will be stable inasmuch as the top and bottom walls of the bags will remain generally parallel whether they are flat and unexpanded as illustrated in FIG. 3 or expanded as illustrated in FIG. 2. The male and female hook and loop pile fastener strips may be bonded to the top and bottom walls of the bag with both the top and bottom walls having male and female strips secured thereto to enable the bags to be quickly and easily connected when in their unexpanded, generally flat condition as illustrated in FIG. 3 with the interconnection being maintained while the bags are expanded by the expandable material absorbing water which has entered into the interior of the bag 16 due to its porosity. The weight of the material 24 may be relatively light to enable ease of transport and handling with the water being absorbed not only increasing the volume of the absorbent material but also increasing the weight thereof so that water externally of the bag will not tend to float the bag. In addition, the absorbent material may contain concrete which will also expand and also absorb water and provide additional weight and stabilization to the bag 16 when expanded to form a water containment barrier, wall, dam, levee, or the like. Thus, the combined bag and water absorbent and expandable material in the bag greatly facilitate the construction of a water containment barrier. For example, if a water containment levee is broken or broached by water, a plurality of the bags 16 in their flattened condition, as illustrated in FIG. 3, can be quickly transported to the site of the break and the bags quickly unloaded and positioned to repair the break in the water containment levee. In another use, if water is rising and moving toward a home, manufacturing facilities or other location from which water is to be excluded, a barrier or wall can be constructed around that facility so that as water rises and engages the lowermost layer of bags, the water will be absorbed and the expandable material will expand the bags in the lowermost layer or course and as the water rises, succeeding higher courses of bags will be expanded, thus continuing to form a barrier to flood waters and the like as the flood waters rise so that the flood water containment barrier can be installed prior to flood waters reaching a particular location with the barrier expanding automatically as flood waters reach the barrier. The use of lighter weight bags of relatively small volume when unexpanded enables personnel with less strength and physical capabilities to effectively handle the bags and placement of the bags requires the expenditure of much less energy and labor than sandbags and the bags are more easily and accurately assembled in stacked courses to provide a more effective barrier. While the bags have been illustrated with perpendicularly arranged side and end walls, an alternative construction results in the bags assuming a shape similar to a pillow case when expanded which results from the side and end edges being seamed in any suitable manner. Also, the bags and absorbent material therein may be provided in continuous tear-off rolls.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flood water containment bag for use with identical bags to form flexible water barrier, said bag comprising a peripheral wall means constructed of porous material enabling ingress of water into the interior of the bag, a quantity of water absorbent expandable material in the bag having a small volume when dry and a substantial increase in volume when it has absorbed a maximum quantity of water with the bag being flattened into a small volume when the absorbent material is dry to facilitate transport and handling and being expanded into a substantially larger volume when the water absorbent and expandable material is expanded by absorption of water to form a barrier from a plurality of courses of flattened bags which will expand into a barrier when water penetrates the bags and is absorbed into the absorbent material.

2. The bag as defined in claim 1 together with identical fastening means on opposed surfaces of the bag for interconnecting superimposed bags to maintain them in position.

3. The bag as defined in claim 1 wherein said bag in both its flattened and expanded form is generally rectangular.

4. The bag as defined in claim 1 wherein said bag is constructed of porous material selected from a group consisting of non-woven, woven, knit, paper and plastic material.

5. The bag as defined in claim 1 wherein said water absorbent material is selected from a group consisting of starch-grafted copolymer of polyacrylic acid and polyacrylamide, modified cellulose fiber in the form of carboxymethylcellulose, internally cross-linked starch-grafted polyacrylate polymer derived from starch and acrylic acid, aqueous polymer solution and hydrophilic polymer.

6. The bag as defined in claim 6 wherein said bag is constructed from the material in a group consisting of non-woven, woven, knit, paper and plastic material all of which are porous.

7. The bag as defined in claim 7 wherein said water absorbent material is combined with a wicking material to enhance absorption of water.

8. The bag as defined in claim 7 wherein said bag is constructed of perforated plastic material.

9. A bag associated with a plurality of identical bags to form a liquid barrier, said bag comprising peripheral walls constructed of material permitting passage of liquid and liquid absorbing expandable material in the bag, said liquid absorbing expandable material occupying a relatively small volume as compared to the maximum interior volume of the bag when dry to enable the bags and material therein to be stored, transported and placed in position to form a liquid barrier while in compact lightweight condition, said liquid absorbing expandable material increasing in volume when liquid penetrates the peripheral walls and is absorbed with the expandable material increasing to a volume substantially equal to the maximum interior volume of the bag and increase the weight thereof to form a liquid barrier when a plurality of bags are positioned in vertically stacked horizontal courses.

10. The bag as defined in claim 9 wherein said peripheral walls form a generally rectangular bag in both compact and expanded condition.

11. The method of forming a water barrier comprising the steps of constructing a bag of flexible water porous material, placing a small quantity of water absorbing expandable material in the bag when dry with the expandable material occupying a small portion of the maximum interior volume of the bag, closing the bag to prevent egress of the expandable material from the bag, storing, transporting and positioning a plurality of bags while in a dry lightweight, compact condition with the bags being positioned to form a water barrier, and contacting the bags with water for passage through the porous material into the interior of the bags for contact with the water absorbing and expandable material to increase the total weight of the bag and increase the volume of the expandable material to a volume substantially equal to the maximum interior volume of the bag to form a stable water barrier.

* * * * *

Notice of Adverse Decisions in Interference

In Interference No. 102,012, involving Patent No. 4,650,368, R. T. Bayer, FLOOD WATER CONTAINMENT BAG, final judgment adverse to the patentee was rendered Jan. 22, 19991, as to claims 1-11.

(*Official Gazette August 27, 1991*)